US005403021A

United States Patent [19]

Shifrin

[11] Patent Number: 5,403,021

[45] Date of Patent: Apr. 4, 1995

[54] BRAKE ASSEMBLY FOR IN-LINE ROLLER SKATES

[76] Inventor: Roy Shifrin, P.O. Box 5096, Hanover, N.H. 03755

[21] Appl. No.: 202,756

[22] Filed: Feb. 28, 1994

[51] Int. Cl.[6] ..... A63C 17/14

[52] U.S. Cl. ..... 280/11.2; 188/29

[58] Field of Search ..... 280/11.19, 11.2, 11.22; 188/29, 57

[56] References Cited

U.S. PATENT DOCUMENTS

| | | | |
|---|---|---|---|
| 4,084,831 | 4/1978 | Akonteh et al. | 280/11.2 |
| 4,234,204 | 11/1980 | Tibbals | 280/11.2 X |
| 5,135,244 | 8/1992 | Allison | 280/11.2 X |
| 5,232,231 | 8/1993 | Carlsmith | 280/11.2 |
| 5,320,367 | 6/1994 | Landis | 280/11.2 |

*Primary Examiner*—Margaret A. Focarino
*Assistant Examiner*—Michael Mar
*Attorney, Agent, or Firm*—Sughrue, Mion, Zinn, Macpeak & Seas

[57] ABSTRACT

A brake assembly for in-line roller skates includes a frame having an inverted U-shaped configuration secured to a skate boot. A plurality of wheels are mounted in line for rotation in the frame and an elongated brake lever is pivotally mounted in the frame above the wheels for pivotal movement into sequential engagement with the wheels beginning with a rear wheel. Aligned apertures are provided in the skate boot and the frame to permit toe operation of the lever to pivot the lever against the force of an adjustable spring.

4 Claims, 2 Drawing Sheets

FIG.1
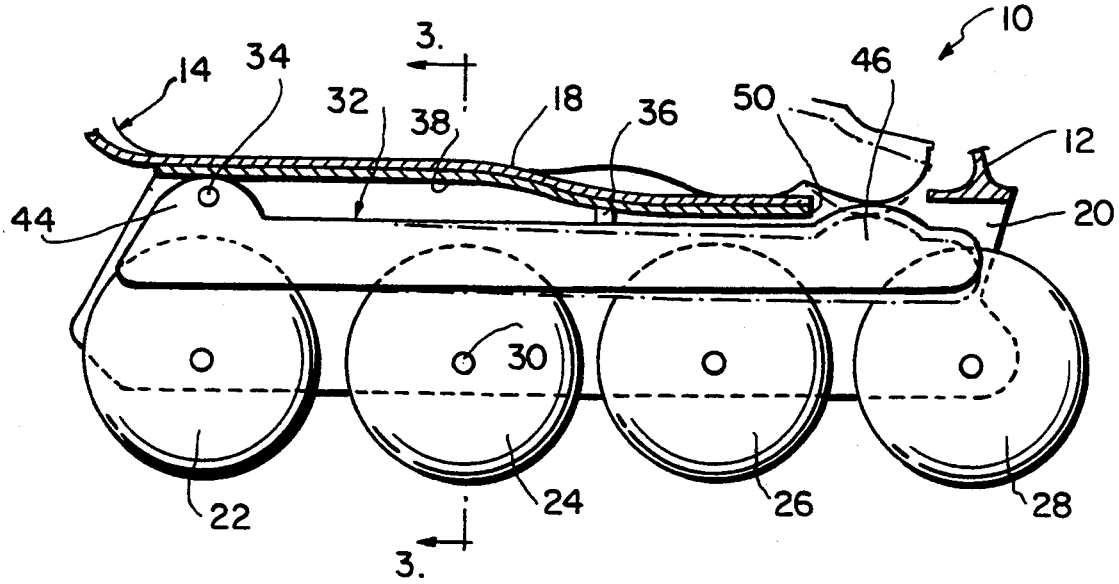
FIG.2
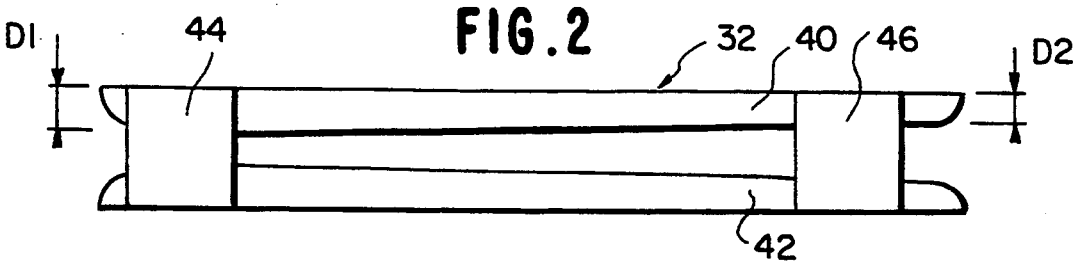
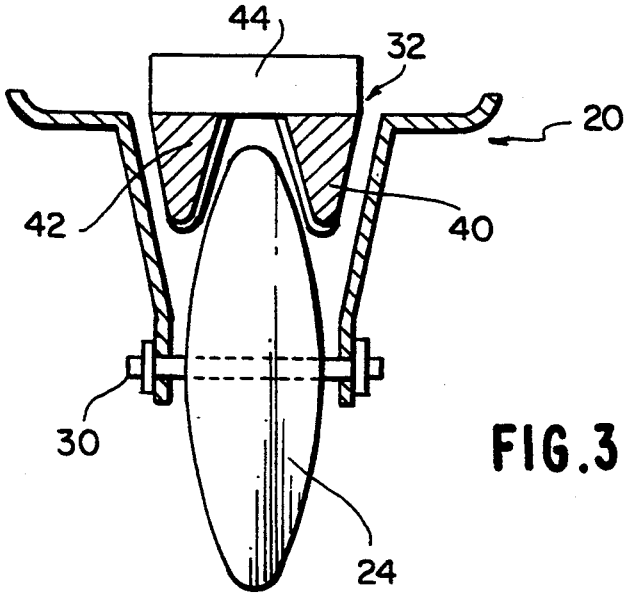
FIG.3

FIG.4
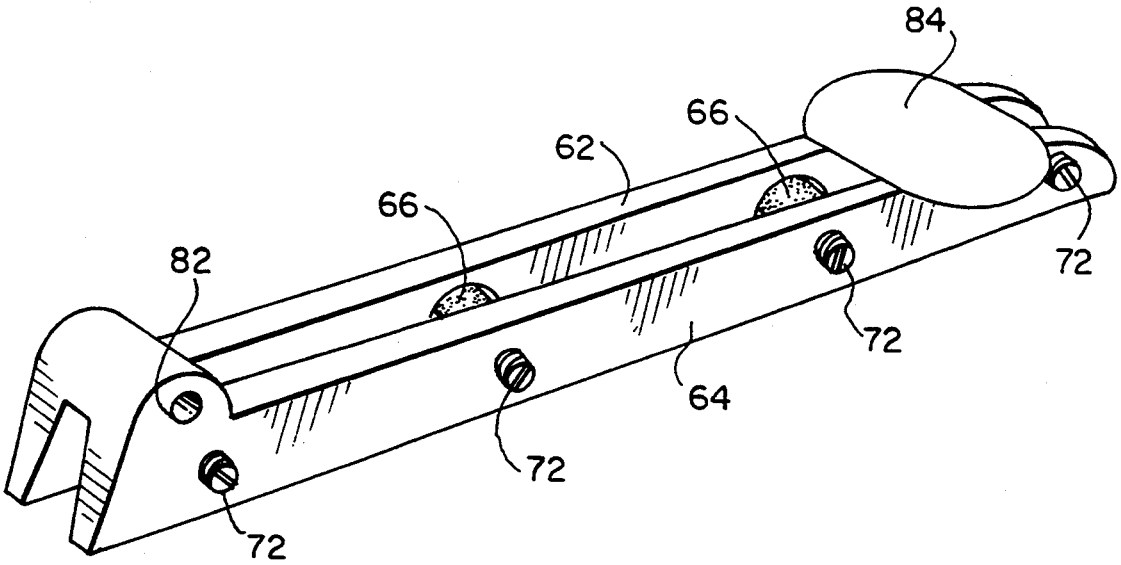
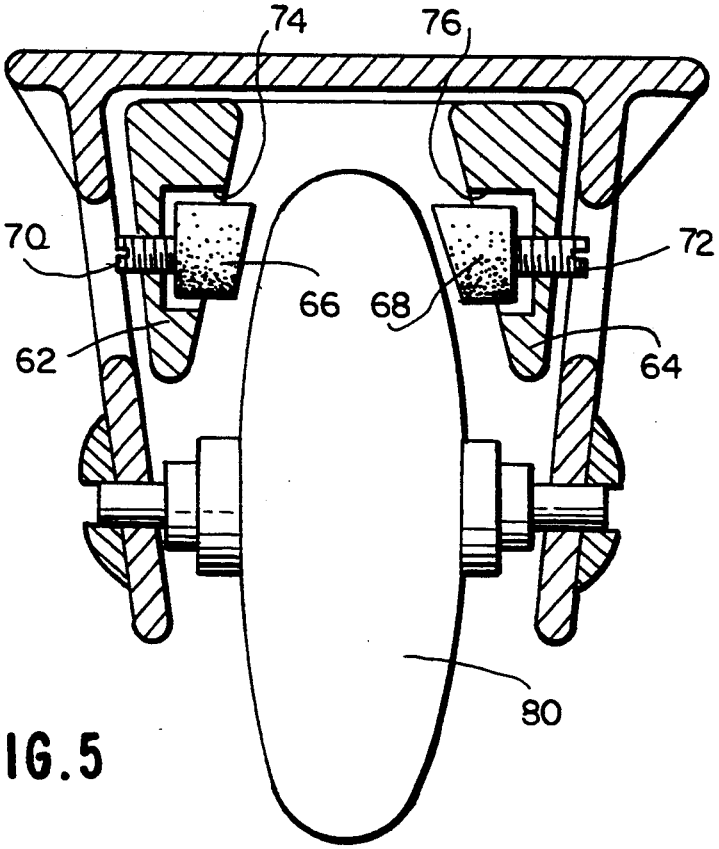
FIG.5

BRAKE ASSEMBLY FOR IN-LINE ROLLER SKATES

BACKGROUND OF THE INVENTION

The present invention is directed to a brake assembly for in-line roller skates and more specifically to a toe actuated pivoted brake member for progressively applying pressure from the rearmost wheel to the forwardmost wheel.

In the art of roller skating, the problem of stopping has always been a challenge. For many years, roller skates were not provided with any specific braking means whatsoever and it was necessary to either drag the wheels on one skate sideways or to provide a pad adjacent the toe portion of the skate which could be pressed against the ground to slow or stop the skater.

With the advent of in-line roller skates, the above methods of stopping proved to be unacceptable. The wheels on an in-line roller skate are considerably narrower than conventional roller skates and any lateral dragging of the wheels would cause undue wear and misalignment of the wheels. Furthermore, in-line roller skates generally have the forwardmost wheel located adjacent the very tip of the boot so that the provision of a toe-type brake pad was bound to be unworkable.

The U.S. patent to Colla (U.S. Pat. No. 5,143,387) discloses a roller skate brake assembly having a toe actuator within the boot. A slide bar is mounted below the sole of the boot for fore and aft sliding movement above the wheels. One or more brake pads are provided on the slide bar for engagement with the wheels. Spring means are provided for normally biasing the slide bar forwardly to bring the brake pads out of engagement with the wheels. The forward end of the slide has an upstanding toe actuator extending into the boot so that upon movement of the toes, the slide can be moved rearwardly against the force of the spring means to bring the brake pads into engagement with the wheels.

SUMMARY OF THE INVENTION

The present invention is directed to a new and improved brake assembly for in-line roller skates having a toe actuated lever pivotally mounted for a progressive application of braking pressure from the rear wheel to the front wheel.

The present invention provides a new and improved brake assembly for in-line roller skates comprising frame means adapted to be connected to a skate boot below a sole thereof, a plurality of wheels rotatably mounted on the frame means in alignment with each other, brake lever means pivotally mounted on the frame means adjacent a rear portion of the frame means, spring means mounted between said brake lever and said frame means for normally biasing a forward end of said lever upwardly away from said wheels and friction means mounted on said brake lever for engaging said wheels upon pivotal movement of said brake lever downwardly against said spring means upon application of foot pressure thereto.

A skate boot may be secured semi-permanently or detachably to the frame means and complementary apertures are provided in a sole of the boot and the frame means to permit contact between a skater's toes and a toe pad mounted on a forward end of said brake lever. The brake pads may be rigidly secured to the brake lever or may be adjustably mounted thereon whereby the brake pads will be progressively applied from the rearmost wheel to the forwardmost wheel so as to provide slowing and stopping from the rear forward so that the skater is not pitched forward.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a partial longitudinal sectional view of an in-line roller skate according to the present invention.

FIG. 2 is a top plan view of the brake lever as shown in FIG. 1.

FIG. 3 is a sectional view taken along the line 2—2 of FIG. 1.

FIG. 4 is a perspective view of a modified form of brake lever according to the present invention.

FIG. 5 is a transverse sectional view similar to FIG. 3 but showing the brake lever according to FIG. 4.

DETAILED DESCRIPTION OF THE INVENTION

An in-line roller skate 10 is shown in FIG. 1 which includes a skate shoe 12 for enclosing the foot 14 of a skater and an in-line roller assembly adhered to the sole 18 of the skate boot 12 by any suitable means. The in-line roller assembly 16 may be secured to the sole 18 in a semi-permanent manner by means of rivets or the like or may be detachably secured to the skate boot by means of releasable clamps or other types of detachable devices.

The in-line roller assembly 16 is comprised of a substantially inverted U-shaped frame 20 having four rollers 22, 24, 26, 28 rotatably mounted therein on suitable axles extending between the sides of the U-shaped frame 20. Such an axle 30 is shown in FIG. 3 upon which the roller 24 is mounted for rotation. Most in-line roller blade skates utilize four rollers which are aligned with each other for rotation in a common plane. The rollers have an oval configuration as viewed from the front or rear, as best seen in FIG. 3 whereby minimal contact is provided between the roller and the ground. The number of rollers, as well as the shape of the rollers, may vary.

The brake assembly is comprised of a brake lever 32 which is pivotally mounted between the side walls of the U-shaped frame 20 on a pivot pin 34 extending between the side walls of the frame in a manner similar to the wheel axle 30. The pin 34 is mounted above and parallel to the axle of the rear wheel 22 and the lever is normally biased upwardly as viewed in FIG. 1 by means of an elastic strip 36 secured between the upper wall 38 of the frame 20 and the brake lever 32. Any other type of spring means may be readily used in lieu of the elastic strip 36 as long as the forward end of the brake lever 32 is biased upwardly.

As best seen in FIGS. 2 and 3, the brake lever 32 is comprised of two elongated tapered portions 40 and 42 which are interconnected by transverse members 44 and 46. Each of the longitudinally extending members 40 and 42 taper in the longitudinal direction with the width D1 at the rear end of the brake lever being greater than the width D2 at the forward end of the brake lever. The longitudinally extending members 40 and 42 are also tapered to provide a substantially triangular cross-sectional configuration as best seen in FIG. 3.

The entire brake lever assembly may be molded as a unitary body. The pivot pin 34 is located in the rear transverse member 44 and the forward transverse member 46 is rounded in the upper direction to provide a toe pad for engagement by one or more toes of the skater.

In order to achieve the toe engagement as shown in FIG. 1, the sole 18 of the skate boot and the upper wall 38 of the frame 20 are provided with aligned apertures to define an opening 50 into which the rounded projecting surface 46 of the brake lever will project. By flexing the toes downwardly, a skater may pivot the brake lever 32 downwardly about the pivot pin 34 to bring the longitudinally extending members 40 and 42 into frictional contact with the opposite side of each roller. Due to the longitudinal tapering of the longitudinal members 40 and 42, the brake lever 32 will engage the rear wheel 22 first as shown in dotted lines in FIG. 3. Subsequent pressure by the toes will gradually bring the brake lever into sequential engagement with the rollers 24, 26 and 28, respectively. In this way, the application of braking pressure to the rear wheel first will prevent the skater from being pitched forwardly. The braking is controlled inside the skate boot by downward brake pedal-like action of the big toe. This is an easy and natural action with the braking device flush with the sole of the boot so as not to interfere with foot comfort or the natural pressures on the foot and toes while skating. The degree of pressure required to apply the braking device is adjustable by utilizing elastic bands or strips 36 of different elasticity to accommodate the need and comfort on individual skaters.

A modified form of the brake lever is shown in FIG. 4 wherein 4 pairs of opposed brake pads are mounted along the length of the brake lever 60. The brake lever 60 is comprised of two longitudinally extending members 62 and 64 which are as best seen in FIG. 5, similar to the longitudinally extending members 40 and 42 in the previous embodiment. The adjustable brake pads 66 and 68 are adjusted at each wheel to provide engagement with the wheels as desired by the skater. Each of the brake pads 66 and 68 are connected to screw members 70 and 72, respectively. Each brake pad 66, 68 is located in a complementary recess 74, 76, respectively in the longitudinally extending members 62 and 64. The screw members 70 and 72 are threaded through the longitudinally extending members where by upon turning the screws, the individual pads will move toward or away from the roller 80 as best seen in FIG. 5. The brake lever 60 is pivotally mounted in the frame similar to the manner in which the brake lever 32 is pivotally mounted in the frame 20 in the first embodiment. Suitable adjustable spring means may be provided similar to the spring means shown in the first embodiment for normally biasing the brake lever 60 upwardly in a counterclockwise direction about a pivot pin which would extend through the hole 82 at the rear of the brake lever 60. The toe pad 84 would be engaged by the big toe similar to the previous embodiment for pressing the brake pads into engagement with the wheels of the skate from the rear to the front.

While the brake levers may be made of any desirable friction material ordinarily used in brake assemblies which is molded to the desired configuration, it is also possible, especially with respect to the second embodiment to construct the brake lever from aluminum or any other suitable material since the braking is accomplished by means of the brake pads 66 and 68 which may be of any desirable friction material ordinarily used in brake assemblies.

While the brake lever in each embodiment may be pivoted downwardly by downward pressure of one or more toes of the skater, it is also possible to provide other types of suitable actuators for the brake lever which could be controlled by movement of one or more toes or the foot in any direction.

While the invention has been particularly shown and described with reference to preferred embodiments thereof, it will be understood by those in the art that the foregoing and other changes in form and details may be made therein without departing from the spirit and scope of the invention.

What is claimed is:

1. A brake assembly for an in-line roller skate comprising:

elongated frame means having an inverted U-shaped configuration adapted to be secured to a skate boot;

a plurality of wheels mounted for rotation in-the frame means in alignment with each other for rotation in a common plane;

brake lever means comprising a pair of elongated spaced apart members interconnected by transversely extending connectors disposed at front and rear ends thereof, said brake lever being disposed between said wheels and said U-shaped frame with said elongated members disposed on opposite sides of said wheels;

pivot means pivotally mounting said rear end of said lever means in the frame means adjacent a rearmost wheel for pivoting said lever means toward and away from said wheels, spring means normally biasing said lever means away from said wheels, and friction means associated with each of said spaced apart members, said friction means including opposed contact portions for engaging said wheels, said contact portions being spaced apart in an outwardly tapering manner from the rear end to the front end so as to provide sequential engagement of said contact positions with said wheels beginning with said rearmost wheel.

2. A brake assembly as set forth in claim 1, wherein said pair of spaced apart members are longitudinally extending members tapering in width and height from a large dimension adjacent a rear end thereof to a small dimension adjacent a forward end thereof, said contact portions being formed along inner surfaces of said longitudinally extending members.

3. A brake assembly as set forth in claim 1, wherein said pair of spaced apart members are comprised of two parallel elongated members each having a plurality of recesses adjacent each wheel, said contact portions being formed by a friction pad located in each recess and screw means connecting each of said friction pads adjustably to said brake lever to achieve sequential engagement with said wheels beginning with said rearmost wheel.

4. A brake assembly as set forth in claim 1, further comprising a skate boot secured to the upper surface of said frame means, aligned apertures in said skate boot and said frame means in the vicinity of a skater's big toe whereby manipulation of said toe can initiate movement of said lever means.

* * * * *